US005083929A

United States Patent [19]

Dalton

[11] Patent Number: 5,083,929

[45] Date of Patent: Jan. 28, 1992

[54] GROUNDING BULKHEAD CONNECTOR FOR A SHIELDED CABLE

[75] Inventor: David A. Dalton, Saratoga, Calif.

[73] Assignee: Hewlett-Packard Company, Palo Alto, Calif.

[21] Appl. No.: 719,079

[22] Filed: Jun. 17, 1991

Related U.S. Application Data

[63] Continuation of Ser. No. 510,389, Apr. 17, 1990, abandoned.

[51] Int. Cl.[5] ..... H01R 4/66

[52] U.S. Cl. ..... 439/98; 439/610; 174/35 C

[58] Field of Search ..... 174/35 C, 78; 439/98, 439/99, 607, 610

[56] References Cited

U.S. PATENT DOCUMENTS

| | | | |
|---|---|---|---|
| H379 | 12/1987 | Alexander, Jr. | 439/610 |
| 3,435,126 | 3/1969 | Hamilton | 174/78 |
| 4,257,658 | 3/1981 | Hammond et al. | 439/98 |
| 4,416,501 | 11/1983 | Fusselman et al. | 439/396 |
| 4,721,483 | 1/1988 | Dickie | 439/610 |
| 4,916,804 | 4/1990 | Yoshimura et al. | 439/98 |
| 4,963,104 | 10/1990 | Dickie | 439/610 |

FOREIGN PATENT DOCUMENTS

| | | | |
|---|---|---|---|
| 90539 | 10/1983 | European Pat. Off. | 439/610 |

*Primary Examiner*—Gary F. Paumen

[57] ABSTRACT

A bulkhead grounding connector for a multi-conductor shielded cable is fabricated from a base and an identical cover. A resilient plastic tube is positioned within the cable between its metal foil and wire braid layers and provides a spring-like surface to push the wire braid against rigid conductive fingers located on the inner surface of the base and cover. Scraping motion of the fingers against the wire braid during assembly ensures removal of resistive oxides from the braid. Sharp dimples positioned longitudinally on the inner surface of the base and cover provide additional ground connection around the circumference of the cable.

14 Claims, 4 Drawing Sheets

GROUNDING BULKHEAD CONNECTOR FOR A SHIELDED CABLE

CROSS REFERENCE TO RELATED APPLICATION

This application is a continuation of application Ser. No. 07/510,389, filed 4/17/90, now abandoned.

BACKGROUND AND SUMMARY OF THE INVENTION

Many electronic instruments and computers generate undesirable high frequency signals during operation. In order to meet government and industry specifications for radio frequency interference (RFI) the enclosure surrounding the instrument or computer must prevent radiation of the signals beyond the enclosure. Modern enclosures are often constructed as electrically grounded conductive cages in order to minimize RFI.

An improperly grounded electrical cable that is routed through the bulkhead of an enclosure may act as an antenna and may transmit RFI signals beyond the enclosure. A typical data cable that is routed through an enclosure bulkhead may include as many as ninety-six individually insulated internal data lines surrounded by an inner layer of metal foil, an outer layer of braided wire and an insulating layer. In order to achieve the best ground connection, and the best RFI performance, a good electrical connection must exist between the metal foil layer and the bulkhead.

Prior art cable connectors have often provided inconsistent ground performance and have often been difficult to assemble. One prior art connector, disclosed in U.S. Pat. No. 4,416,501, uses a metal ferrule to provide a rigid surface against which legs of a U-shaped clip are spread. During assembly, the ferrule is positioned between the foil layer and the wire braid layer. The U-shaped clip is then pressed onto the cable and the rigid ferrule causes the legs to separate so that tines on the clip cut through the insulator and contact the foil. The clip is small and inherently difficult to position and the tines often provide an inadequate ground connection between the cable and the bulkhead.

In accordance with an illustrated preferred embodiment of the present invention, a bulkhead connector is easy to assemble and provides a consistent and effective ground connection between a cable and a bulkhead. The connector is assembled from a metal base and an identical metal cover that fit together to contain the cable. A resilient tube positioned between the foil and the wire braid of the cable provides a resilient surface pushing against the interior surface of the connector. Angled fingers on the interior surface of the connector base and cover scrape resistive oxides from the wire braid as the connector is assembled onto the cable and provide tight mechanical, and effective electrical, connection between the wire braid and the connector. A tight spring-like connection is created by the deformation of the tube and the resultant radial pressure against the opposing rigid fingers. Dimples on the interior surface of the base and cover ensure that an effective ground connection exists around the full circumference of the cable.

DETAILED DESCRIPTION OF THE PREFERRED EMBODIMENT

Figure 1:
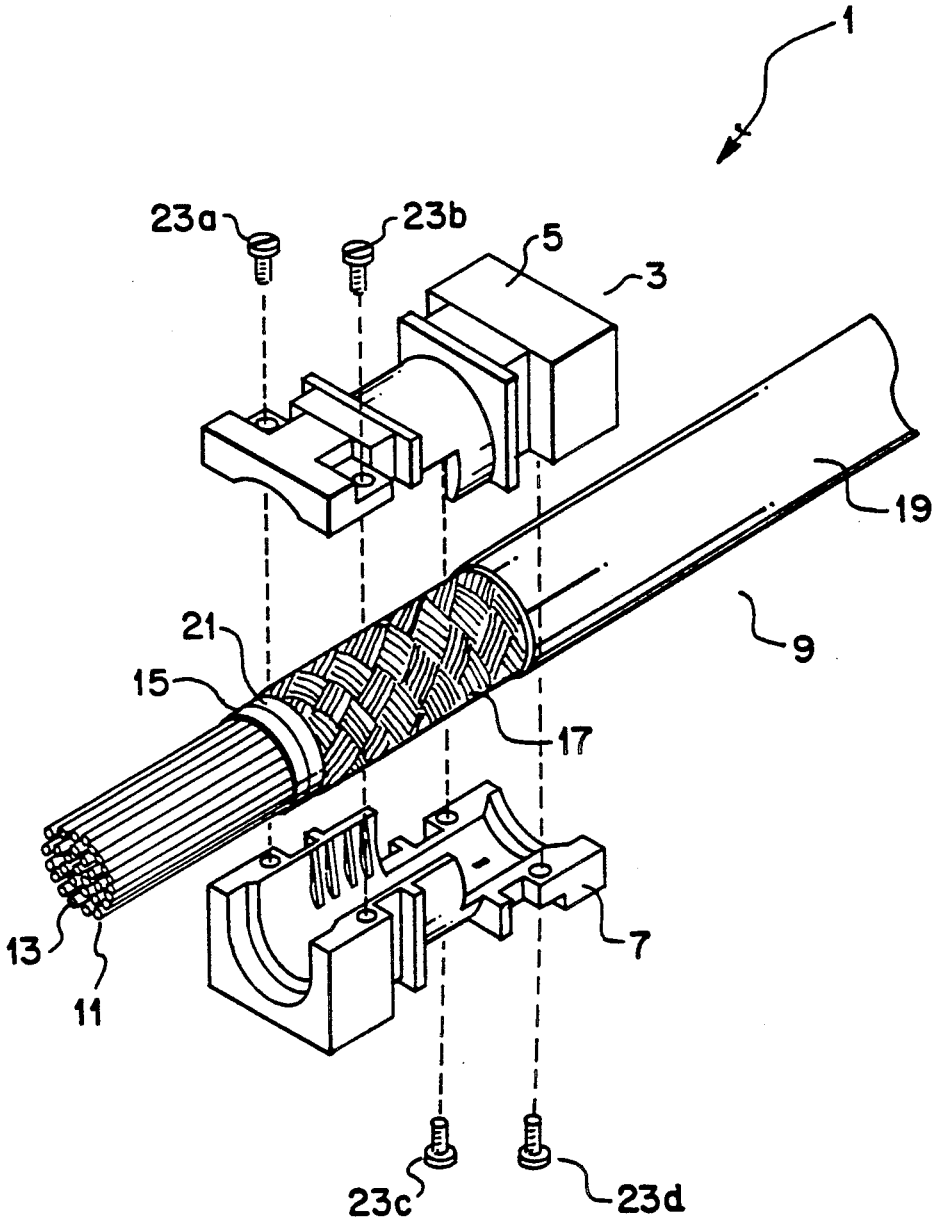
FIG. 1 shows an exploded view of a grounding bulkhead connector assembly constructed according to an illustrated preferred embodiment of the present invention.

FIG. 1 shows a grounding bulkhead connector 3 which is used in conjunction with a cable 9 and a plastic tube 21 to form a connector assembly 1. The connector 3 includes a cover 5 and an identical base 7 which are assembled together using four screws 23*a–d*. The cover 5 and base 7 are cast from zinc and are plated with a conductive coating of nickel. A multi-conductor shielded cable 9 of the type shown in FIG. 1 may be obtained from any of a number of manufacturers such as Carol Co. or E. I. DuPont de Nemours and Co. A typical cable 9 includes a central bundle 11 of up to ninety-six or more individually insulated 28 gauge internal data lines 13. A thin inner layer of foil 15 forms a Faraday cage within the cable 9 to minimize transmission of RFI. The foil 15 typically comprises a long strip of metallized Mylar sheet wrapped around the bundle 11. An outer layer of wire braid (grounding layer) 17 forms a final metallic protective surface over the foil 15. An insulator 19 provides insulation and protection for the cable 9.

Figure 2:
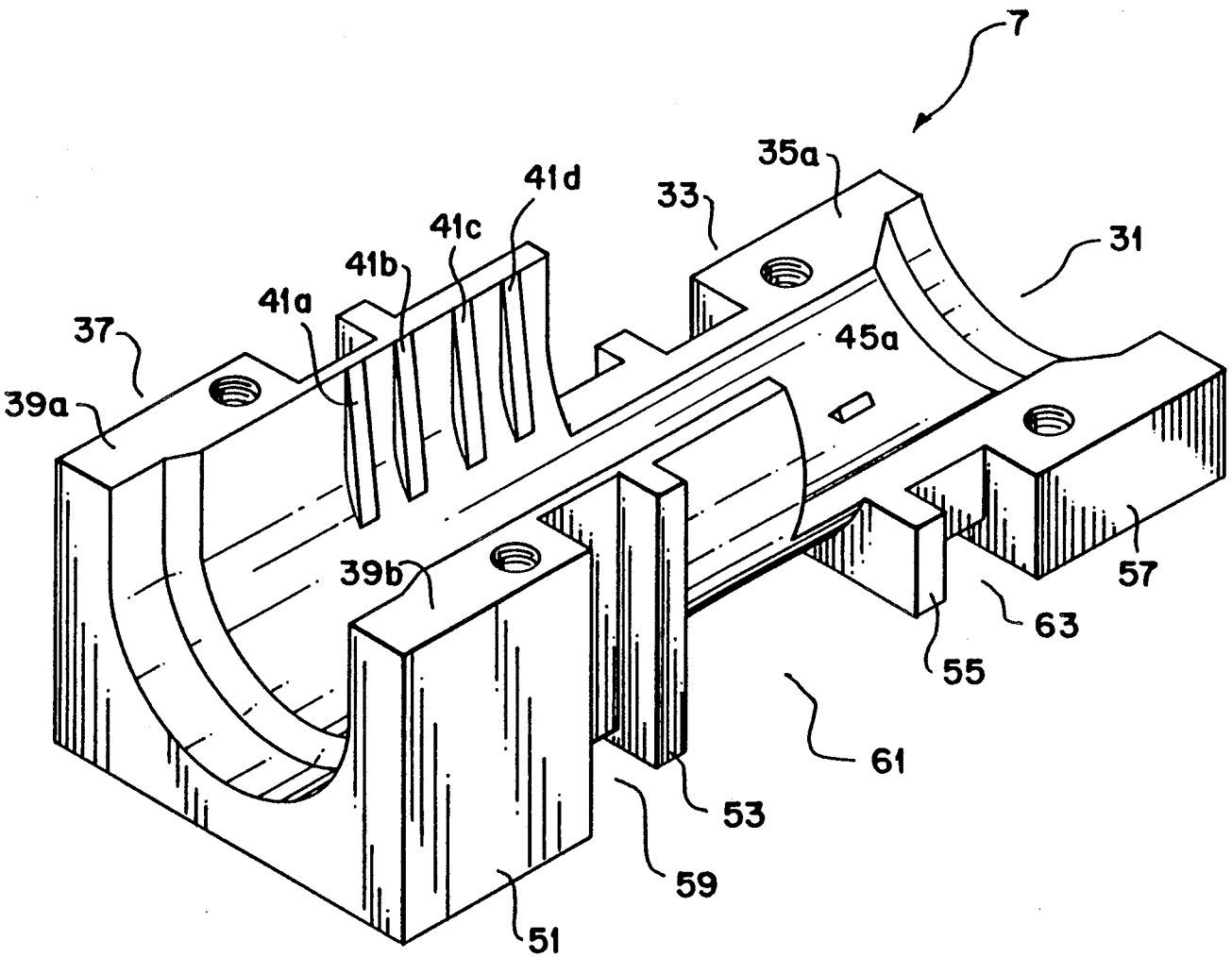
FIG. 2 shows an enlarged detail view of the base shown in FIG. 1.
Figure 4:
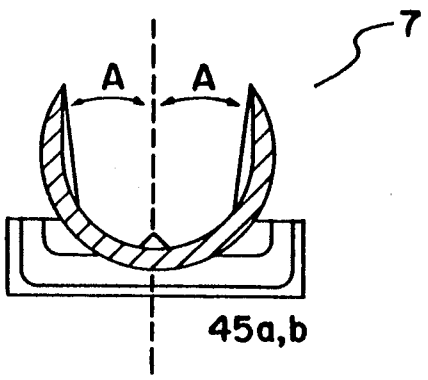
FIG. 4 shows a cut-away view, along lines A—A, of the base shown in FIG. 3.
Figure 3:
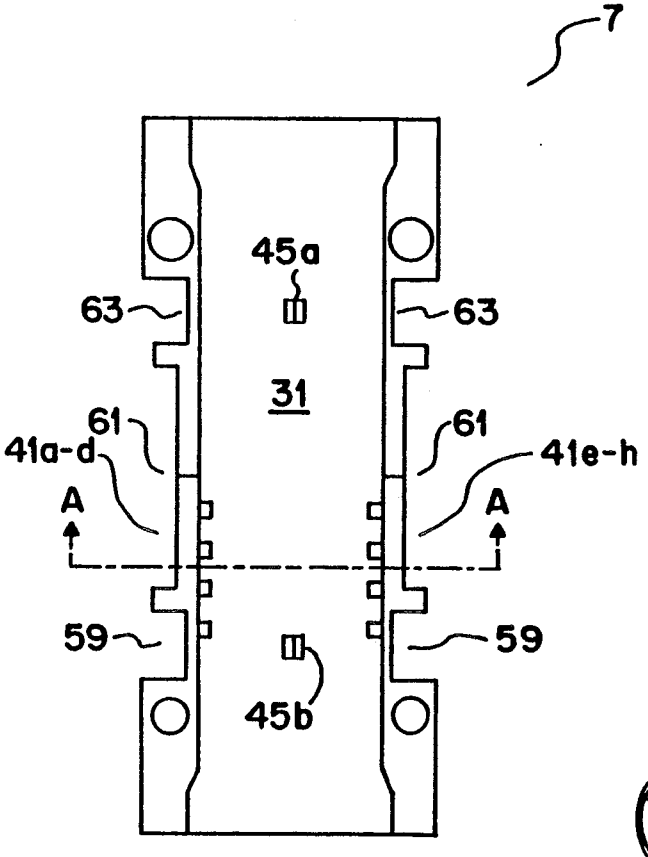
FIG. 3 shows a top view of the base shown in FIG. 2.

FIGS. 2, 3 and 4, respectively, show an enlarged detail view, a top view and a cut-away view (along lines A—A) of the base 7 shown in FIG. 1. The cover 5 and base 7 are identical and, when assembled together, define an axial curved channel 31 for receiving and containing the cable 9. The cable 9, with the insulator 19 removed and the tube 21 positioned between the foil 15 and the braid 17, is contained tightly within the connector 3 without damage. In order to accomplish this preferred fit, the diameter of the channel 9 is approximately equal to the outside diameter of the tube 21. In the illustrated preferred embodiment shown in FIGS. 1–4, the diameter of the channel 9 is 0.400 inch. In the illustrated preferred embodiment shown in FIGS. 1 and 5, the braid 17 has a thickness of 0.010 inch, the bundle 11 contains 96 individual 28 gauge data lines 13 each having thin wall insulation, the foil 15 has a thickness of approximately 0.5 mil, and the thickness of the insulator 19 is approximately 0.035 inch.

The base 7 is made up of two sections 33, 37. The tall section 37 has opposing tall walls 39*a, b* each having a height roughly equal to two-thirds the outside diameter of the tube 21. The short section 33 has opposing short walls 35*a, b* each having an interior height roughly equal to one-third the outside diameter of the tube 21. Thus, when the cover 5 and base 7 are assembled together in a vertical attachment direction, the interior heights of the walls 35, 37 add so that the diameter of the channel 31 is approximately equal to the outside diameter of the tube 21.

The interior height of the tall walls 39 a, b may be decreased, if necessary, but should be kept greater than one-half the outside diameter of the tube 21. At lower interior heights the fingers 41 would be unable to scrape across the surface of the braid 17 to remove the resistive layer of oxide and the quality of the ground connection would decrease. The interior height of the tall walls 39*a, b* may be increased, if necessary, although an excessive interior height would result in an overly large diameter at the top of the channel 31. Of course, the interior height of the short walls 35*a, b* would also have to be varied inversely with the interior height of the tall walls 39*a, b.*

The base 7 includes opposing fingers 41*a–d* and 41*e–h* located on the interior surface of the tall walls 39*a, b.* Each of the fingers 41 used in the illustrated preferred embodiment shown in FIGS. 1–4 is 0.225 inch long and 0.030 inch wide and is 0.015 inch deep at its deepest point. Each of the fingers 41 has two opposed side surfaces and a grounding layer engagement surface. The fingers 41 are spaced 0.060 inch apart and each finger 41 is flush with the surface of the channel 31 at the top and bottom points of each finger 41. Each of the fingers 41 is angled outward slightly from the vertical (which is parallel to the vertical attachment direction) at an angle of tilt A as shown in FIG. 4. The preferred angle of tilt A for each of the fingers 41 is approximately 7 degrees although other angles of tilt (e.g., between 5 and 12 degrees) are possible.

The base 7 also includes triangular dimples 45*a, b* centered on the bottom of the base 7 interior surface. Each of the dimples 45 has a height of 0.010 inch and a relatively sharply pointed top as shown in FIG. 4.

The total exterior length of the base 7 is approximately 1.6 inches. The exterior height of the tall section 37 is approximately 0.375 inch and the exterior width of the tall section 37 is approximately 0.63 inch. The exterior height of the short section 33 is approximately 0.19 inch and the outside width of the short section 33 is approximately 0.69 inch. The base 7 also includes flanges 51 and 57 having mounting holes for the screws 23*a–d*. These flanges 51, 57, along with additional flanges 53 and 55, define 0.19 inch wide mounting slots 59 and 63. Flanges 53 and 55 also define a 0.5 inch wide clip slot 61 for placement of a mechanical mounting device, such as a clip, providing mechanical and electrical connection of the connector 3 to a bulkhead.

Figure 5:
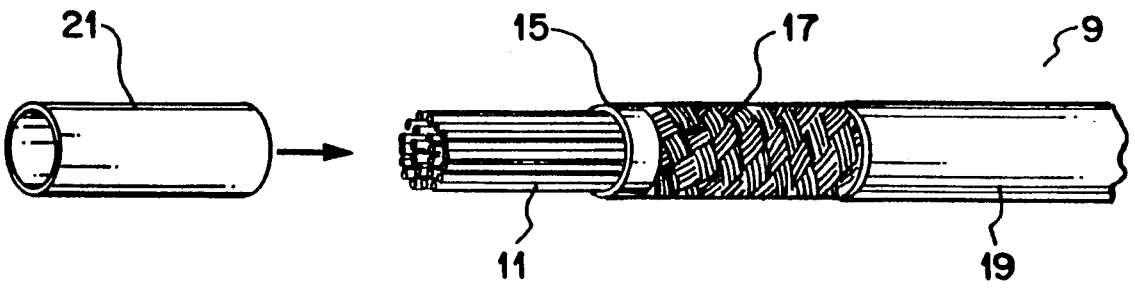
FIG. 5 shows a detailed view of the tube and the multiconductor shielded cable shown in FIG. 1.

FIG. 5 shows a detailed view of the cable 9 just prior to placement of the tube 21 between the foil 15 and the braid 17. The insulator 19 should be removed from a sufficient portion of the cable 9 that good electrical and mechanical contact with the cable 9 is maintained within the connector 3. Alternatively, a cable 9 not having an insulator 19 at all may be used. Enough of the foil 15 and braid 17 should be removed to allow an adequate length of the bundle II for electrical connections to be made. The braid 17 may be peeled back a small amount to allow the tube 21 to be slipped between the foil 15 and the braid 17. The tube 21 should be approximately the same length as the base 7 to permit good electrical and mechanical contact throughout the length of the channel 31. The inside diameter of the tube 21 should be slightly greater than the outside diameter of the foil 15 to allow easy assembly. Since the tube 21, and not the bundle 11, provides support for the fingers 41 the outside diameter of the bundle 11 may be much smaller than the inside diameter of the tube 21 without decreasing the quality of the ground connection. If desired, the tube 21 may be positioned between the bundle 11 and the foil 15 although some damage may occur to the thin foil 15 due to the scraping action of the fingers 41. If the outside diameter of the bundle 11 is sufficiently large to provide resilient support for the fingers 41 it may be possible under some circumstances to eliminate the tube 21. If the tube 21 is eliminated, the diameter of the channel 31 should be equal to, or slightly smaller than, the outside diameter of the braid 17.

As discussed above, the outside diameter of the tube 21 determines the diameter of the channel 31 and the interior heights of the short and tall walls 35, 39. The wall thickness and wall material of the tube 21 should be selected so that the tube 21 has a sufficient spring rate to provide good contact between the fingers 41 and the braid 17. If the tube 21 is made out of a material (e.g., paper) that is too deformable or too soft, it will generate a force that is too low to create good contact. Alternatively, if the tube 21 is made out of a material that is too rigid (e.g., thick-wall steel) no deformation will occur and the fingers 41 will cut through both the braid 17 and the foil 15. In the illustrated preferred embodiment, the tube 21 is fabricated from PTFE Teflon tubing, is 1.6 inch long and has an inside diameter of 0.315 inch and an outside diameter of 0.375. In the illustrated preferred embodiment the tube 21 has a calculated spring rate of 20 pounds per inch which provides a good resilient surface to provide contact against the fingers 41. It is possible that a tube 21 having a spring rate in the range of 5–1000 pounds per inch would create an acceptable ground contact.

Figure 6:
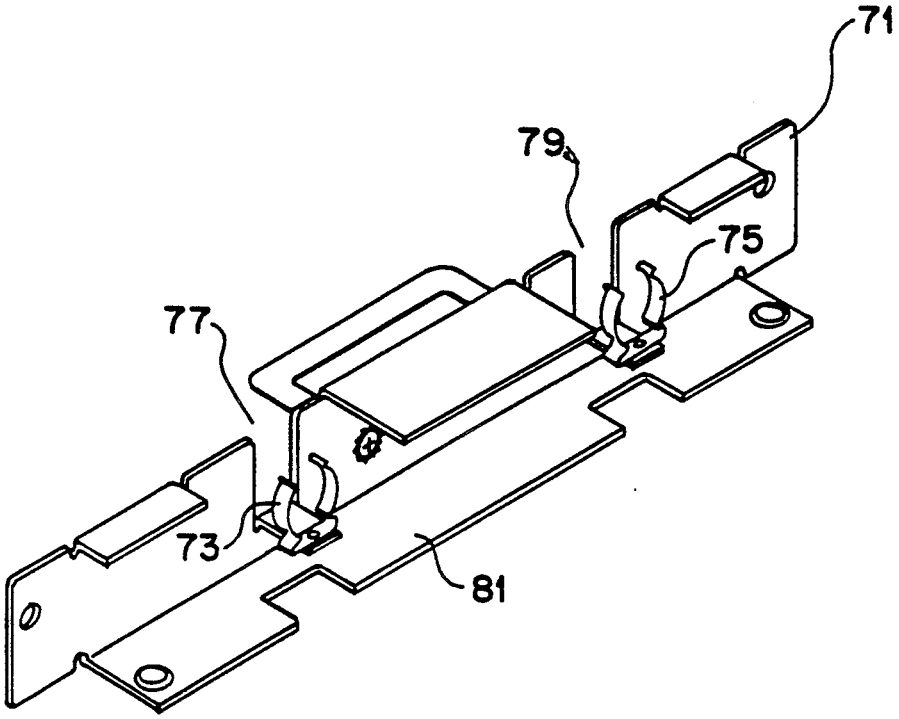
FIG. 6 shows a perspective view of a typical bulkhead that may be used in conjunction with the connector assembly shown in FIG. 1.
Figure 7:
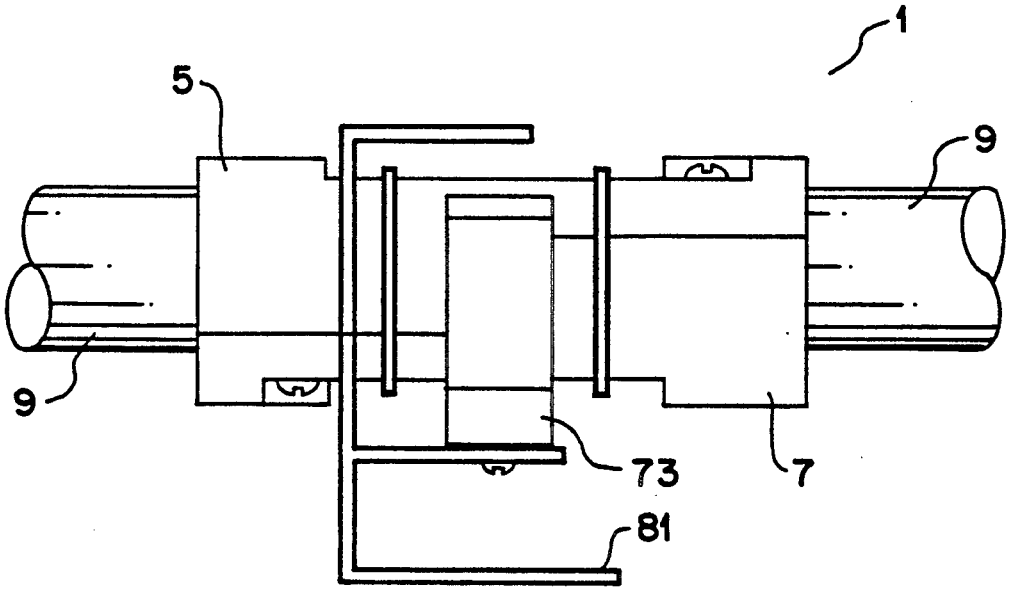
FIG. 7 shows a side view of the connector assembly shown in FIG. 1 as mounted in the bulkhead shown in FIG. 6.

FIG. 6 shows a perspective view of a typical bulkhead 71 that may be used in conjunction with the connector assembly I. FIG. 7 shows a side view of the connector assembly 1 mounted in the bulkhead 71 shown in FIG. 6. Fuse clips 73 and 75 may be used to provide good electrical and mechanical connection of two connector assemblies to the bulkhead 71. The connector assemblies 3 fit within the connector slots 77, 79 and a printed circuit board may be attached to the PC flange 81.

I claim:

1. A connector for providing mechanical and electrical connection between a bulkhead and a tubular cable that has one or more internal lines within an outer conductive grounding layer, the connector comprising:

a base including a tall section, the tall section having an interior surface that extends to a tall section top at an interior height that is less than an outside diameter of the grounding layer;

a cover, attachable to the base in a vertical attachment direction, for completing containment of the cable within the channel;

an interior axial and generally curved tubular channel for containing the cable, the channel being defined by the interior surface of the tall section and having a diameter that is approximately equal to the outside diameter of the grounding layer;

one or more fingers, each finger having two opposed side surfaces and a grounding layer engagement surface, the fingers being located within the tall section, extending inwardly from the interior surface of the tall section into the channel and being approximately orthogonal to the axis of the channel, each finger including a top that is tilted radially away at an angle of tilt from a vertical plane parallel to the vertical attachment direction:

wherein each of the grounding layer engagement surfaces is substantially straight; and such that the fingers are positioned to scrape the grounding layer during placement of the cable within the channel in order to provide an effective electrical connection between the grounding layer and the connector.

2. A connector as in claim 1, wherein the curve of each of the fingers has a diameter that is greater than the diameter of the channel.

3. A connector as in claim 1, wherein the interior height of the tall section is greater than $\frac{1}{2}$ of the outside diameter of the grounding layer and less than or equal to approximately $\frac{2}{3}$ of the outside diameter of the grounding layer.

4. A connector as in claim 3, wherein the top of each of the one or more fingers is positioned substantially at the top of the tall section.

5. A connector as in claim 1, further comprising a resilient tube positionable between the internal lines and the grounding layer such that a resilient radial force may be exerted upon the grounding layer against the one or more fingers.

6. A connector as in claim 5, wherein the tube has a spring rate between 5 pounds/inch and 1000 pounds/inch.

7. A connector as in claim 6, wherein the spring rate is approximately 20 pounds/inch.

8. A connector as in claim 7, wherein the tube is fabricated from PTFE Teflon.

9. A connector as in claim 1, wherein:

the grounding layer includes an inner layer and an outer layer; and further comprising a resilient tube positionable between the inner and outer layers such that a resilient radial force may be exerted upon the outer layer against the fingers.

10. A connector as in claim 1, wherein the base further includes a short section, adjacent to the tall section, the short section having an interior surface that defines the channel and that extends to a short section top at an interior height that is substantially equal to the outside diameter of the grounding layer minus the interior height of the tall section.

11. A connector as in claim 10, wherein the cover is substantially identical to the base when rotated about an axis perpendicular to a longitudinal axis of the channel, such that the short section of the cover is positionable upon the tall section of the base and the tall section of the cover is positionable upon the short section of the base.

12. A connector as in claim 1, wherein the angle of tilt is between 5 and 12 degrees.

13. A connector as in claim 12, wherein the angle of tilt is approximately 7 degrees.

14. A connector as in claim 1, further comprising one or more dimples positioned along the bottom of the interior surface of the tall section and extending into the channel.

* * * * *